US009500139B2

(12) United States Patent
Yun et al.

(10) Patent No.: US 9,500,139 B2
(45) Date of Patent: Nov. 22, 2016

(54) VARIABLE INTAKE THROTTLE VALVE WITH SPRING

(71) Applicants: Hyundai Motor Company, Seoul (KR); Kia Motors Corporation, Seoul (KR)

(72) Inventors: Tae Min Yun, Seongnam-si (KR); Yong Gyo Seo, Suwon-si (KR); Nam Kyun Paek, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 73 days.

(21) Appl. No.: 14/553,882

(22) Filed: Nov. 25, 2014

(65) Prior Publication Data

US 2015/0354417 A1 Dec. 10, 2015

(30) Foreign Application Priority Data

Jun. 5, 2014 (KR) ..... 10-2014-0068250

(51) Int. Cl.

| | |
|---|---|
| ***F02D 9/10*** | (2006.01) |
| ***F01L 1/46*** | (2006.01) |
| ***F01L 1/34*** | (2006.01) |
| ***F01L 3/08*** | (2006.01) |

(52) U.S. Cl.

CPC ..... *F02D 9/1065* (2013.01); *F01L 1/34* (2013.01); *F01L 1/462* (2013.01); *F01L 3/08* (2013.01)

(58) Field of Classification Search

CPC ..... F02D 11/00; F02D 11/04; F02D 9/00; F02D 9/08; F02D 9/1065; F01L 3/08; F01L 1/34; F01L 1/46; F01L 1/462

USPC ..... 123/188.17, 190.1, 337, 376, 402, 403

See application file for complete search history.

(56) References Cited

U.S. PATENT DOCUMENTS

| | | | | |
|---|---|---|---|---|
| 4,860,848 | A * | 8/1989 | Barth | B60K 28/16 123/336 |
| 5,983,858 | A * | 11/1999 | Hashimoto | F02D 9/02 123/396 |
| 6,079,390 | A * | 6/2000 | Hashimoto | F02D 9/02 123/396 |
| 6,488,009 | B2 * | 12/2002 | Sakurai | F02D 9/02 123/361 |
| 6,672,564 | B2 * | 1/2004 | Johann | F02D 9/1065 251/286 |
| 7,063,067 | B2 * | 6/2006 | Kado | F02D 9/1035 123/399 |
| 7,222,603 | B2 * | 5/2007 | Colic | F16K 1/12 123/336 |
| 7,246,794 | B2 * | 7/2007 | Suzuki | F02M 1/10 123/376 |
| 7,503,309 | B2 * | 3/2009 | Tanimura | F02D 41/107 123/396 |
| 2006/0180784 | A1 | 8/2006 | Colic et al. | |

FOREIGN PATENT DOCUMENTS

| | | |
|---|---|---|
| JP | H01-190957 A | 8/1989 |
| JP | 5-321729 A | 12/1993 |

(Continued)

*Primary Examiner* — Grant Moubry

(74) *Attorney, Agent, or Firm* — Morgan, Lewis & Bockius LLP

(57) ABSTRACT

A variable intake valve apparatus may include a fixing pin, wherein a spring may be connected to an outer peripheral surface of the fixing pin, a driving mode portion configured for compressing the spring such that a protrusion formed at a distal end of the spring may be disposed variably depending on a selected driving mode, and a body portion engaged with the driving mode portion and configured for controlling an opening point in time of the intake valve apparatus depending on negative pressure of air on the selected driving mode.

10 Claims, 7 Drawing Sheets

(56) References Cited

FOREIGN PATENT DOCUMENTS

| | | | |
|---|---|---|---|
| KR | 20-1999-0019380 | U | 6/1999 |
| KR | 10-2008-0022891 | A | 3/2008 |
| KR | 10-2010-0130895 | | 12/2010 |
| KR | 10-2012-0062258 | | 6/2012 |
| KR | 10-1382282 | | 4/2014 |

* cited by examiner

VARIABLE INTAKE THROTTLE VALVE WITH SPRING

CROSS-REFERENCE(S) TO RELATED APPLICATION

The present application claims priority to Korean Patent Application No. 10-2014-0068250, filed Jun. 5, 2014, the entire contents of which is incorporated herein for all purposes by this reference.

BACKGROUND OF THE INVENTION

Field of the Invention

The present invention relates to a variable intake valve with a spring, and more particularly, to a variable intake valve with a spring to solve a problem in that a spring valve is applied to adjust the opening point in time (i. e., a timely opening) of the variable intake valve according to taste of a driver and according to an exemplary embodiment of the present invention, the intake valve is open or blocked according to a driving mode selected by the driver even when negative pressure with small amount of air is loaded, thereby the intake valve is opened only at one point in time, not at a lot of points in time as in a conventional art which does not reflect taste of a driver.

Description of Related Art

Generally, an intake system of a vehicle engine is designed such that air that has passed through an air cleaner pushes a flap of an air flow meter and appropriate amount of air can be inhaled to a combustion chamber according to the opening degree of a throttle valve.

At this time, the inflowing air has an influence on output and fuel efficiency of an engine, therefore it is evaluated to be preferable that oversupply of fuel is retrained by minimizing inhalation resistance and allowing a mixture of fuel and air to be an ideal air/fuel ratio.

Accordingly, a throttle body, a substantial passage through which air is inflow is better to have a structure capable of reducing the resistance of pipelines, and also needs to be designed such that air flow resistance to a valve is to be small when the throttle valve is opened and closed.

The air volume required for combustion is varied when a vehicle drives or idly rotates, and especially is relevant to output when driving, therefore there is a limit in improving an output with only the degree of opening and closing of a throttle valve.

Accordingly, an intake port is divided into two passages, one passage of which forms a spiral to achieve a swirl operation, and also a swirl control valve is installed in the other passage and thereby is given a function of a variable intake valve that blocks the passage during low-speed driving and allows the passage to open during high-speed driving.

Meanwhile, since a device for opening and closing of a conventional variable intake valve is designed to control an actuator with ECU, a solenoid that is electronically controlled becomes a requisite component and also a control portion of ECU needs to be additionally mounted, and thus structural complexity thereof is inevitable.

As a result, even though there is an opening and closing device of a variable intake valve through DC motor system, since this is controlled with ECU in addition to separate DC motor, a solenoid that is electronically controlled becomes a requisite component and thus manufacturing costs are increased and its structure becomes complicated.

Meanwhile, fresh air (external air) is supplied to a combustion chamber of an engine through an intake duct 20→an air cleaner 40→an intake hose 30 during an intake stroke of an engine piston, and FIG. 1 is a view illustrating a variable intake valve using a conventional spring. The operation principle is as follows New air enters into an engine through two intake ports such that a spring valve 10 is closed at a low output and the spring valve 10 is open at a high output to supply much more external air to the engine than at the low output.

Meanwhile, reviewing an operating principle of a spring valve with reference to FIGS. 2A to 2C, FIG. 2A is a view showing a closed state of the spring valve, FIG. 2B is a view showing an open state of the spring valve, and FIG. 2C is a view showing a state that a spring 100 is coupled to a fixing pin 200.

Since much external air supplies to an engine are necessary at a high output than at a low output, when a negative pressure of the inhaled external air (forces for pulling a valve backward) is greater than elastic force (forces for closing a valve) of a spring 100 coupled to an outer circumferential surface of a fixing pin 200, a spring valve 10 is open.

However, this spring valve 10 that is currently used has an advantage that cost is greatly cheap, but the spring valve 10 is open only at one point in time where a negative pressure of the inhaled external air is greater than elastic force of a spring 100 coupled to an outer circumferential surface, and thus has a problem that it is hard to change an opening point in time of the spring valve 10 according to taste of a driver.

That is, in accordance with a selection of a driver it wishes to implement a sporty sound color with intake air discharging noise throughout the whole range from low output to high output on "sports mode", and implement a function of reducing the intake air discharging noise on "comport mode." However, a spring valve 10 according to a related art is opened only at one point in time, and thus has a problem that a driver does not determine the opening point in time of the spring valve 10.

As the invention related to the spring valve, various prior documents are disclosed, including a conventional art entitled "variable intake mechanical device", however, inexpensive spring valve is used wherein a technology of tuning the opening point in time of a spring valve at three points in accordance with a selection of a driver, like the present invention, is in a poor state.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing a variable intake valve with a spring capable of controlling the output of an engine by changing an opening point in time of an intake valve according to a taste selected by a driver to solve problems in the related arts as stated above, also easily adjusting the opening point in time of the intake valve, and tuning the opening point in time of three types of intake valve by adopting a low-priced spring valve used in the related art.

In an aspect of the present invention, a variable intake valve with a spring characterized in that an opening point in time of an intake valve is varied depending to a driving mode by controlling a driving point in time of a spring that opens and closes the intake valve with a restore force thereof.

The spring is connected to an outer peripheral surface of a fixing pin, including a driving mode portion for compressing the spring such that a protrusion formed at a remote end of the spring is disposed variably depending on a selected driving mode, and a body portion for controlling an opening point in time of the intake valve depending on negative pressure of air on the selected driving mode.

The driving mode portion may further include a spring compression control plate on an outer peripheral surface of which a plurality of screw grooves vertically to a length direction of the fixing pin and which is connected to at one point of a remote end of the spring wherein it is connected to an outer peripheral surface of the fixing pin, and a control unit on which gears to be engaged with the plurality of screw grooves are formed.

Driving modes to be selected by a driver are displayed on the control unit, and the spring compression control plate and the spring are compressed when the control unit is rotated depending on the driving modes such that the protrusion formed on a remote end of the spring is disposed variably.

The body portion is formed as a hollow housing, and a guide along which the protrusion formed on a remote end of the spring is movable depending on the selected driving mode and a plurality of slot stoppers vertical to the guide are formed on an outer peripheral surface of the housing wherein a length of the slot stopper is gradually increased in accordance with a compression length of the spring.

The negative pressure of air to close the intake valve is increased in proportion to the length of the slot stopper.

A slot groove of a predetermined length is provided on an outer peripheral surface of the body portion, and one end of the control unit is inserted into the slot groove wherein the control unit is supported by a rotation bar passing through a center thereof and a fixing unit disposed on both ends of the rotation bar.

In another aspect of the present invention, a variable intake valve apparatus, may include a fixing pin, wherein a spring is connected to an outer peripheral surface of the fixing pin, a driving mode portion configured for compressing the spring such that a protrusion formed at a distal end of the spring is disposed variably depending on a selected driving mode, and a body portion engaged with the driving mode portion and configured for controlling an opening point in time of the intake valve apparatus depending on negative pressure of air on the selected driving mode.

The driving mode portion may further include a spring compression control plate slidably coupled to an outer peripheral surface of the fixing pin, wherein a plurality of screw grooves is formed on an outer peripheral surface thereof vertically to a length direction of the fixing pin and wherein an end of the spring compression control plate is connected to a distal end of the spring, and a control unit having gears to be engaged with the plurality of screw grooves of the spring compression control plate.

Driving modes to be selected by a driver are configured to be displayed on the control unit, and the spring compression control plate and the spring are compressed when the control unit is rotated depending on the driving modes such that the protrusion formed on the distal end of the spring is disposed variably.

The body portion is formed as a hollow housing, wherein a guide along which the protrusion formed on the distal end of the spring is movable depending on the selected driving mode and a plurality of slot stoppers vertical to the guide are formed on an outer peripheral surface of the body portion, and wherein a length of the slot stopper is gradually increased in accordance with a compression length of the spring.

The negative pressure of air to close the intake valve apparatus is increased in proportion to the length of the slot stopper.

A slot groove of a predetermined length is provided on an outer peripheral surface of the body portion, an end of the control unit is inserted into the slot groove, and the control unit is supported by a rotation bar passing through a center thereof and a fixing unit disposed on both ends of the rotation bar.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
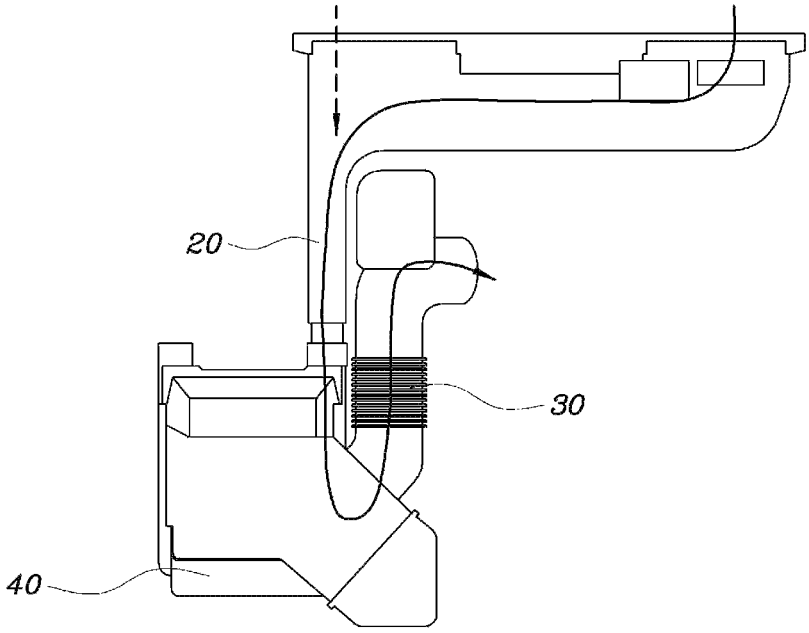
FIG. 1(Related Art)
FIG. 1 is a view illustrating schematically a variable intake valve using a spring according to a related art.
Figure 2A:
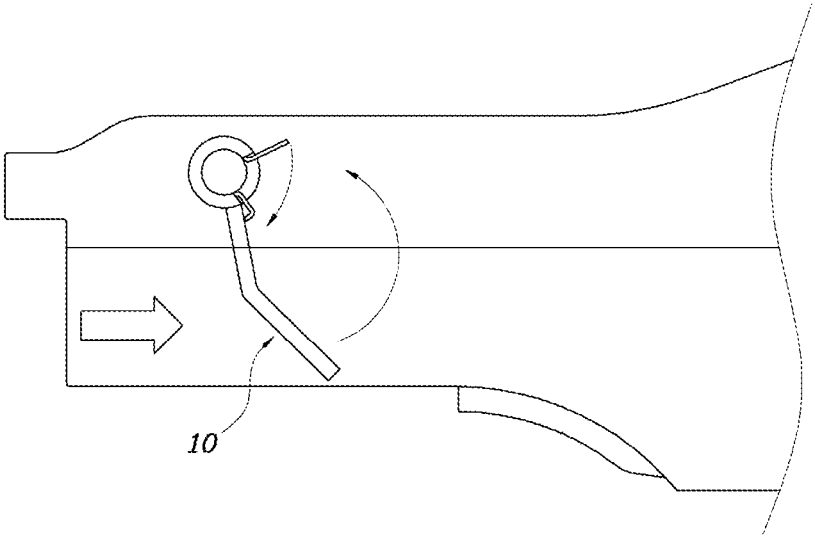
FIG. 2A (Related Art)
FIG. 2A, FIG. 2B and FIG. 2C are views illustrating operation principle of a spring valve according to a related art.
Figure 2B:
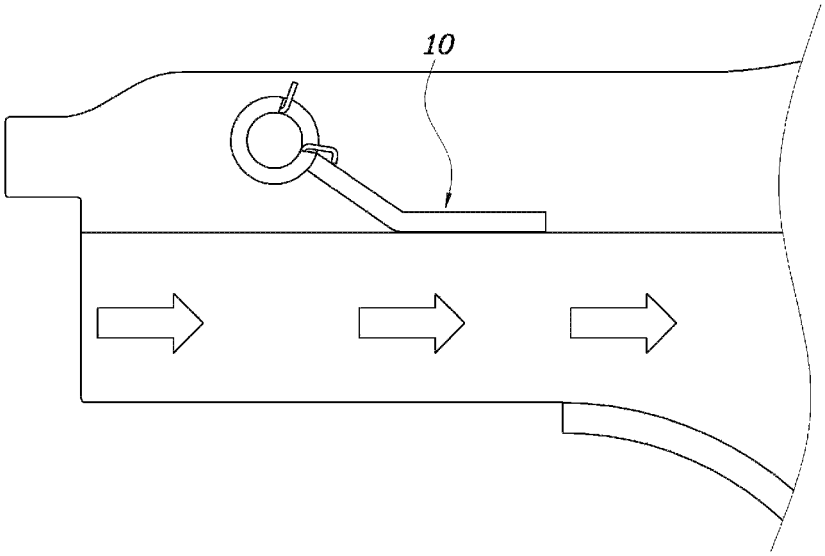
FIG. 2B (Related Art)
Figure 2C:
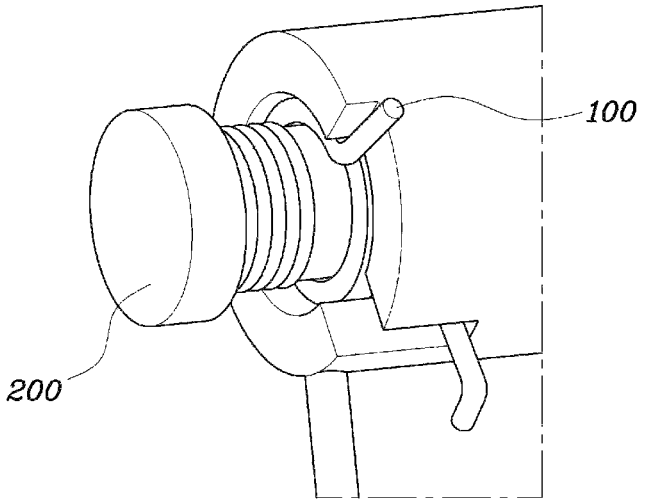
FIG. 2C (Related Art)

It should be understood that the appended drawings are not necessarily to scale, presenting a somewhat simplified representation of various preferred features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Hereinafter reference will now be made in detail to various embodiments of the present invention, examples of which are illustrated in the accompanying drawings and described below. While the invention will be described in conjunction with exemplary embodiments, it will be understood that the present description is not intended to limit the invention to those exemplary embodiments. On the contrary, the invention is intended to cover the exemplary embodiments as well as various alternatives, modifications, equivalents and other embodiments, which may be included within the spirit and scope of the invention as defined by the appended claims.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Hereinafter, a variable intake valve with a spring according to an exemplary embodiment of the present invention is described with reference to the accompanying drawings.

Figure 3:
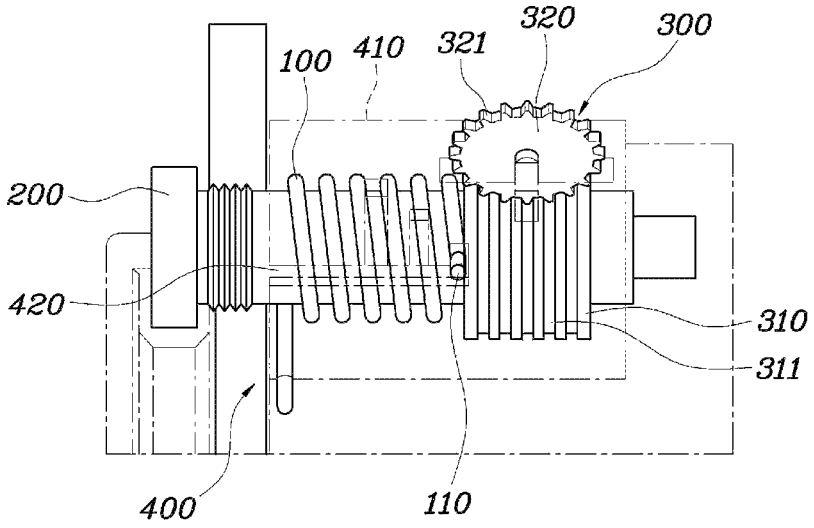
FIG. 3 and FIG. 4 are views illustrating a variable intake valve with a spring according to an exemplary embodiment of the present invention.
Figure 4:
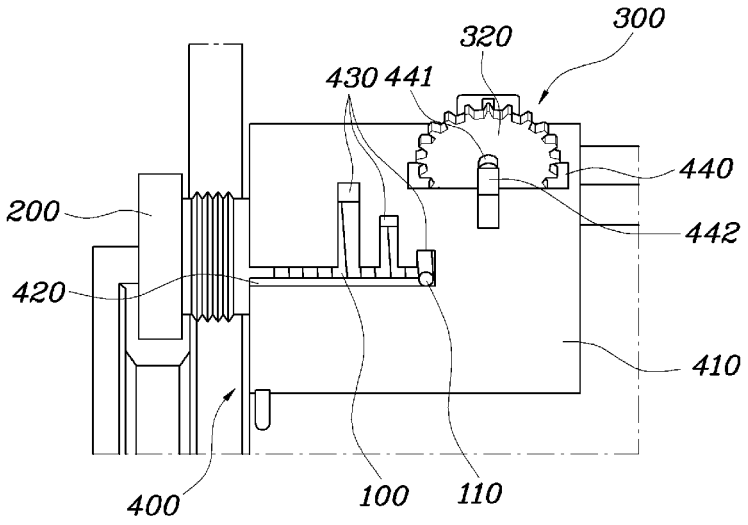

FIG. 3 and FIG. 4 are views illustrating a variable intake valve with a spring according to an exemplary embodiment of the present invention.

The present invention is featured such that an opening point in time of an intake valve is varied depending on a selected driving mode by controlling a driving point in time of a spring that opens and closes the intake valve with its restore force.

The intake valve device a spring valve into which fresh air inflows at a high output of a vehicle in addition to an intake port for fresh air that is inflows at a low output of a vehicle, and the spring is configured to selectively open and close the spring valve with its elastic force.

As illustrated in drawings, a variable intake valve with a spring is provided with a fixing pin 200, a spring 100, a driving mode portion 300, and a body portion 400.

The spring 100 is connected to an outer peripheral surface of the fixing pin 200 and it has elastic force to close the intake valve. When negative pressure of fresh air greater than the elastic force of the spring inflows, the intake valve is opened such that fresh air inflows to an engine at a high output.

Meanwhile, a protrusion 110 of a predetermined length is formed in a vertical direction at a remote end of the spring 100, wherein the location of the protrusion 110 is varied depending on a driving mode selected by a driver.

That is, the protrusion 110 is disposed variably depending on a driving mode selected by a driver while the spring 100 is compressed, wherein the driving mode to be selected by a driver is largely classified as "Comfort mode", "Normal mode" and "Sports mode".

Further, the body portion 400 is included for controlling the opening point in time of an intake valve in accordance with negative pressure of air on the selected driving mode, wherein the protrusion 110 is disposed on the body portion 400 depending on the driving mode selected by a driver and a kind of slot of various lengths through which the protrusion 110 can move vertically as illustrated in drawings is provided on the body portion, which will be described in detail below.

Meanwhile, referring back to FIG. 3 and FIG. 4, the driving mode portion 300 is described as follows.

The driving mode portion 300 includes a spring compression control plate 310 and a control unit 320.

The spring compression control plate 310 is formed in a hollow shape as illustrated in drawings and is connected to a predetermined point of an outer peripheral surface of the fixing pin 200, wherein it is connected to a remote end of the spring 100 and thus when the spring compression control plate 310 moves forward, the spring 100 is also compressed together.

A plurality of screw grooves 311 is provided vertically to a length direction of the fixing pin 200 on an outer peripheral surface of the spring compression control plate 310 and a control unit 320 on which gears 321 to be engaged with the plurality of screw grooves 311 is formed is disposed on an upper end of the spring compression control plate 310.

The control unit 320 is in a circular shape and has a plurality of gears 321 formed thereon and thus when the control unit 320 is rotated, the spring compression control plate 310 is moved to compress the spring 100 connected thereto.

Figure 5:
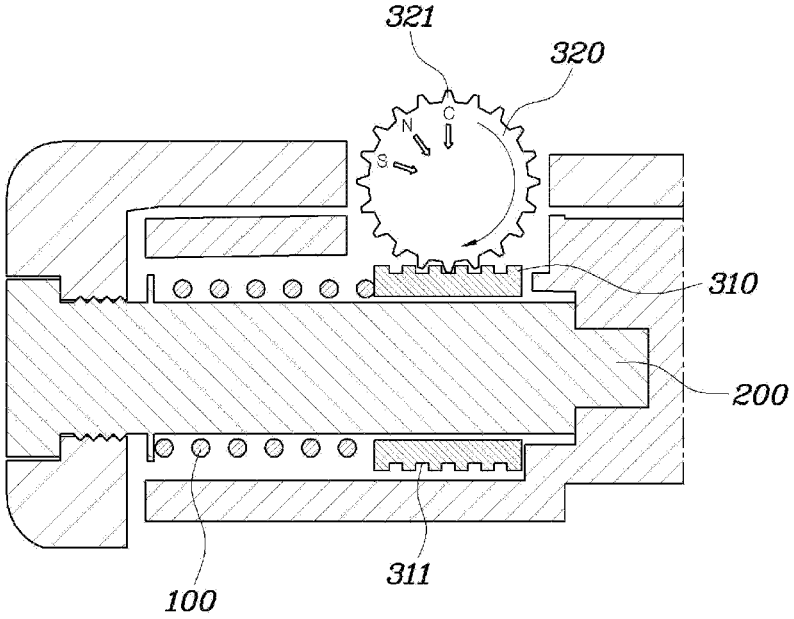
FIG. 5 is a cross-sectional view illustrating a variable intake valve with a spring according to an exemplary embodiment of the present invention.

FIG. 5 is a cross-sectional view illustrating a variable intake valve with a spring according to an exemplary embodiment of the present invention.

As shown in FIGS. 4 and 5, the driving modes to be selected by a driver are displayed on the control unit 320, and when the control unit 320 is rotated depending on the driving mode selected by a driver with his/her taste, the spring compression control plate 310 moves forward with the engagement of the plurality of screw grooves 311 and the gears 3321 thereby to compress the spring 100 to be linked therewith.

The protrusion 110 formed on a remote end of the spring 100 is advanced while the spring 100 is compressed, and then is to be disposed on a slot stopper 430 which will be described below.

Meanwhile, the body portion 400 is formed as a hollow housing 410 in which the fixing pin 200, the spring 100, and the spring compression control plate 310 may be disposed.

A guide 420 is formed on an outer peripheral surface of the housing 410 in a length direction of the fixing pin 200, along which the protrusion 110 formed on a remote end of the spring 100 that is connected to an outer peripheral surface of the fixing pin 200 depending on the driving mode selected by a driver with his/her taste is movable.

The spring 100 is compressed while the spring compression control plate 310 moves forward and the protrusion 110 formed on a remote end of the spring 100 is advanced along the guide 420.

Meanwhile, as illustrated in drawings, a plurality of slot stoppers 430 are formed vertically to the guide 420 wherein each length thereof is varied depending on the selected driving mode.

That is, the length of the slot stopper 430 increases depending on the compression length of the spring 100, and in more detail the length is the longest in a case of "Sports mode", and is the shortest in a case of "Comfort mode".

The reason for varying the length of the slot stopper 430 is as follows.

The protrusion 110 is moved toward the slot stopper 430 and the intake valve is closed with elastic force of the spring 100, wherein the longer a length of the slot stopper 430, the greater the elastic force required for closing the intake valve, and as a result greater negative pressure of air needs to be applied as it proceeds to "Sports mode" from "Comfort mode", thereby eventually closing the intake valve.

As a result, in the case of "Sports mode" even when small amount of negative pressure of air is produced, the intake valve is still in an open state so that the intake valve is opened throughout all sections ranging from a low output to a high output, thereby implementing sporty sound color due to discharging noise of intake air.

On the contrary, in the case of 'Sports mode', a length of the slot stopper 430 is short and thus even when small amount of negative pressure of air inflows, the intake valve is closed with elastic force of the spring so that the intake valve is closed from a low output section to a commonly used low output section, thereby reducing the intake discharging noise and improving performance of an engine.

In addition, in the case of 'Normal Mode', the intake valve is closed only up to a commonly used output section and thus the sense of acceleration power is increased due to increase of intake air discharging noise.

That is, the negative pressure of air capable of closing the intake valve is increased in proportion to the length of the slot stopper 430.

Referring back to FIGS. 4 and 5, the slot groove 440 of a predetermined length is provided on a point of an outer peripheral surface of the body portion 400, and into which one portion of lower end of the control unit 320 is inserted to be engaged with gears 321 formed on the control unit 320 and screw grooves 311 formed on the spring compression control plate 310.

Further, the control unit 320 is supported by a rotation bar 441 passing through a center thereof and a fixing unit 442 that is disposed on both ends of the rotation bar 441, and when the control unit 320 is rotated in accordance with taste of a driver, the protrusion 110 is to be disposed depending on the selected driving mode.

Figure 6A:
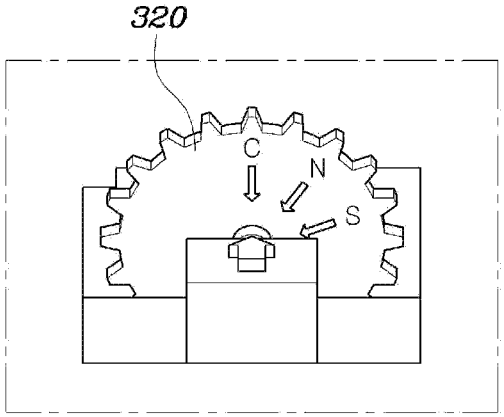
FIG. 6A, FIG. 6B and FIG. 6C are views illustrating a state where a variable intake valve with a spring is operated, according to an exemplary embodiment of the present invention.
Figure 6A:
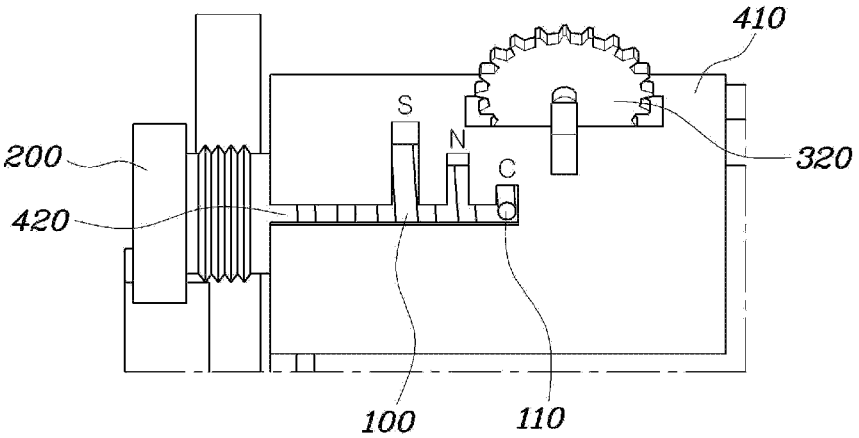
Figure 6A:
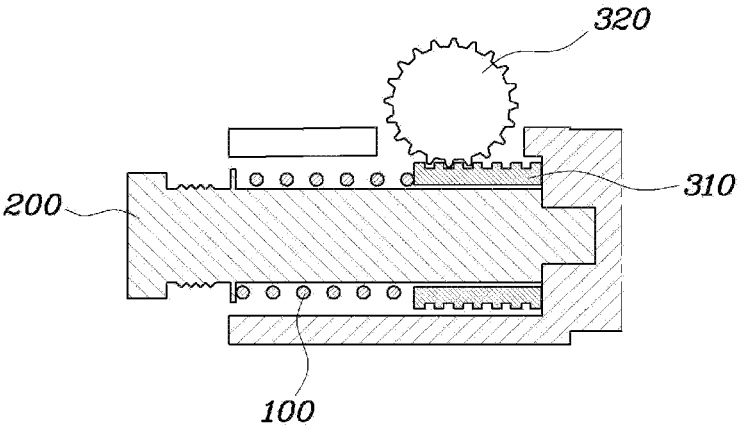
Figure 6B:
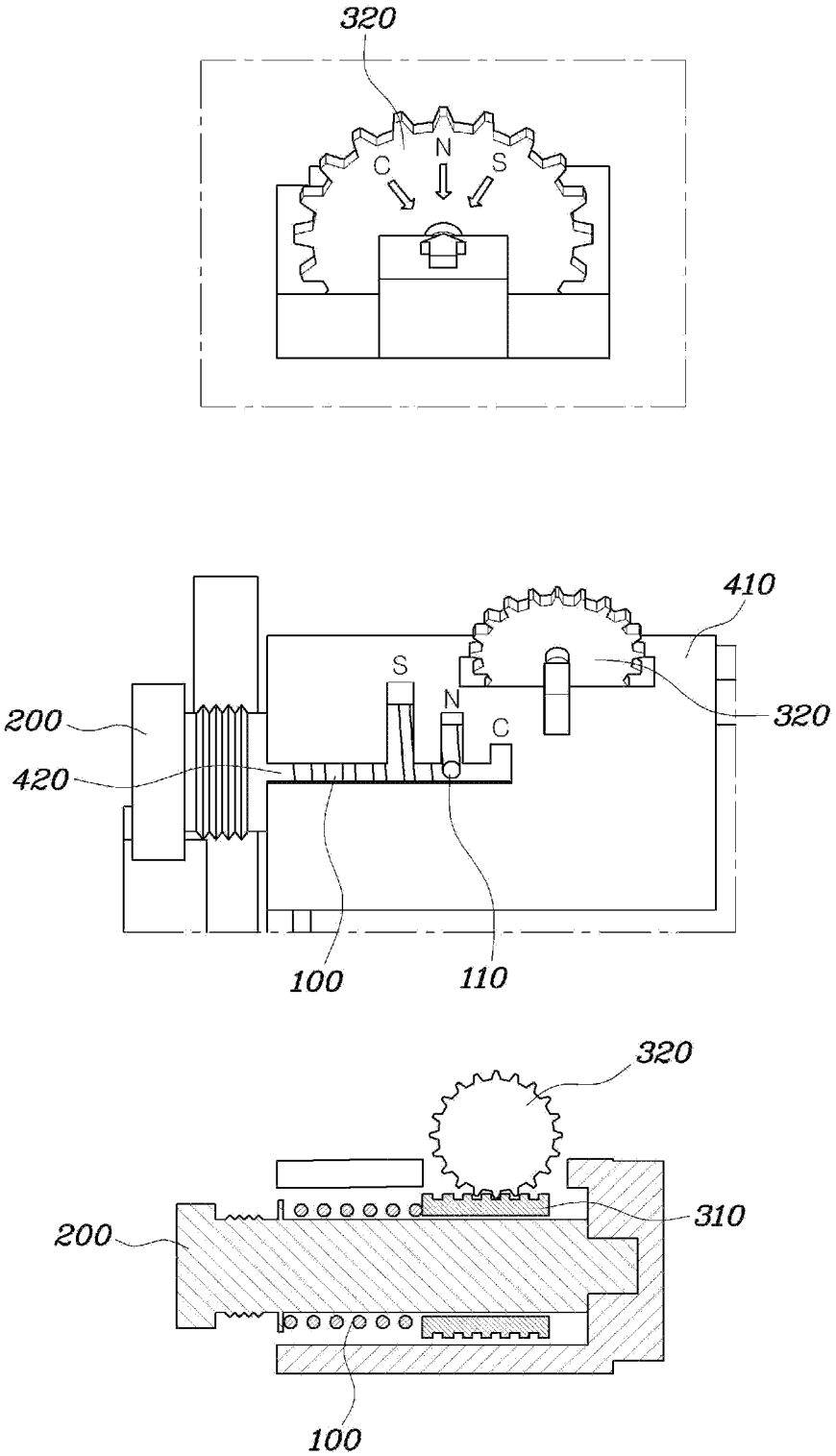
Figure 6C:
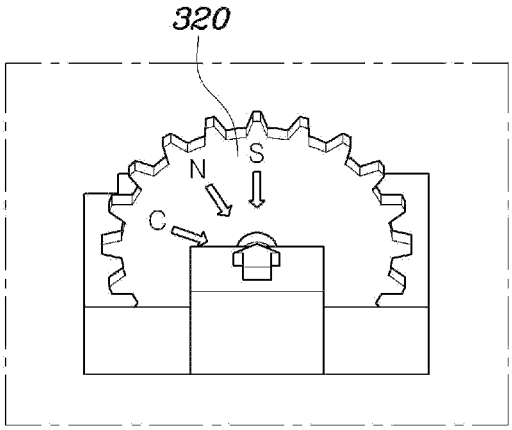
Figure 6C:
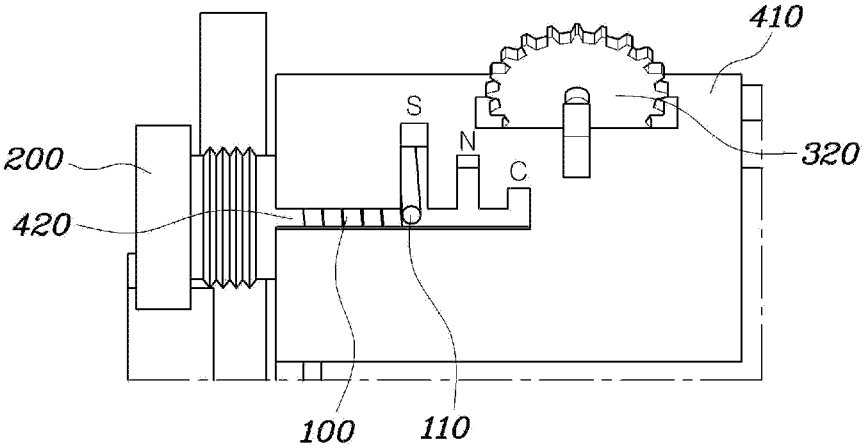
Figure 6C:
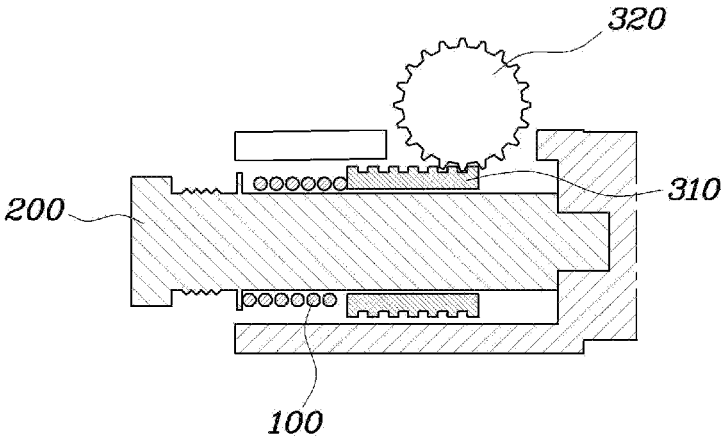

FIG. 6A, FIG. 6B and FIG. 6C are views illustrating an operation state where the protrusion 110 formed on the spring 100 is moved depending on the driving mode and thus an opening point in time of an intake valve is varied.

As shown in FIG. 6A, FIG. 6B and FIG. 6C, the protrusion 110 is to be disposed at longer slot stopper 430 as it proceeds gradually to "Sports mode" from "Comfort mode", and as a result even when small amount of negative pressure of air inflows, the intake valve is still to be opened, and the protrusion 110 is to be disposed at shorter slot stopper 430 as it proceeds gradually from "Sports mode" to " Comfort mode", and as a result even when small amount of negative pressure of air inflows, the intake valve is to be closed.

Through this configuration of an intake valve with a spring, even when a low-priced spring valve of a conventional art is used, the opening point in time of the intake valve is varied depending on a taste of a driver thereby to control the output of an engine, wherein the opening point in time can be varied by simply rotating a controller by a driver.

According to an exemplary embodiment of the present invention configured as described above, various effects may be achieved as below.

First, the output of an engine may be increased due to decrease of negative pressure of intake.

Second, the output of an engine may be controlled by solving a problem in the related art wherein a low-priced spring valve in the related arts is used, and thus cannot change the opening point in time of an intake valve according to a taste of a driver like conventional high-priced actuators or DC motor valves.

Third, an opening point in time may easily be adjusted of an intake valve by simply controlling a control portion of the present invention according to the driver's choice.

Forth, an opening point in time of three types of spring valve may be tuned according to a driver's choice.

For convenience in explanation and accurate definition in the appended claims, the terms "upper", "lower", "inner" and "outer" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A variable intake valve with a spring characterized in that an opening point in time of an intake valve is varied depending to a driving mode by controlling a driving point in time of a spring that opens and closes the intake valve with a restore force thereof, wherein the spring is connected to an outer peripheral surface of a fixing pin, comprising:

a driving mode portion for compressing the spring such that a protrusion formed at a remote end of the spring is disposed variably depending on a selected driving mode; and a body portion for controlling the opening point in time of the intake valve depending on negative pressure of air on the selected driving mode, and wherein the driving mode portion further comprises:

a spring compression control plate on an outer peripheral surface of which a plurality of screw grooves extends transversely to a length direction of the fixing pin and which is connected to at one point of the remote end of the spring, wherein the spring is connected to the outer peripheral surface of the fixing pin; and a control unit on which gears to be engaged with the plurality of screw grooves are formed.

2. The variable intake valve with the spring of claim 1, wherein driving modes to be selected by a driver are displayed on the control unit, and the spring compression control plate and the spring are compressed when the control unit is rotated depending on the driving modes such that the protrusion formed on the remote end of the spring is disposed variably.

3. The variable intake valve with the spring of claim 1, wherein the body portion is formed as a hollow housing, and a guide along which the protrusion formed on the remote end of the spring is movable depending on the selected driving mode and a plurality of slot stoppers vertical to the guide are formed on an outer peripheral surface of the housing wherein a length of each of the plurality of slot stoppers is gradually increased in accordance with a compression length of the spring.

4. The variable intake valve with the spring of claim 3, wherein a negative pressure of air to close the intake valve is increased in proportion to the length of each of the plurality of slot stoppers.

5. The variable intake valve with the spring of claim 3, wherein a slot groove of a predetermined length is provided on an outer peripheral surface of the body portion, and one end of the control unit is inserted into the slot groove wherein the control unit is supported by a rotation bar passing through a center thereof and a fixing unit disposed on both ends of the rotation bar.

6. A variable intake valve apparatus, comprising:

a fixing pin, wherein a spring is connected to an outer peripheral surface of the fixing pin;

a driving mode portion configured for compressing the spring such that a protrusion formed at a distal end of the spring is disposed variably depending on a selected driving mode, wherein the driving mode portion comprises:

a spring compression control plate slidably coupled to the outer peripheral surface of the fixing pin, wherein a plurality of screw grooves is formed on an outer peripheral surface thereof vertically to a length direction of the fixing pin and wherein an end of the spring compression control plate is connected to the distal end of the spring; and a control unit having gears to be engaged with the plurality of screw grooves of the spring compression control plate; and a body portion engaged with the driving mode portion and configured for controlling an opening point in time of the intake valve apparatus depending on negative pressure of air on the selected driving mode.

7. The variable intake valve apparatus of claim 6, wherein driving modes to be selected by a driver are configured to be displayed on the control unit, and wherein the spring compression control plate and the spring are compressed when the control unit is rotated depending on the selected driving mode such that the protrusion formed on the distal end of the spring is disposed variably.

8. The variable intake valve apparatus of claim 6, wherein the body portion is formed as a hollow housing, wherein a guide along which the protrusion formed on the distal end of the spring is movable depending on the selected driving mode and a plurality of slot stoppers vertical to the guide are formed on an outer peripheral surface of the body portion, and wherein a length of each of the plurality of slot stoppers is gradually increased in accordance with a compression length of the spring.

9. The variable intake valve apparatus of claim 8, wherein a negative pressure of air to close the intake valve apparatus is increased in proportion to the length of each of the plurality of slot stoppers.

10. The variable intake valve apparatus of claim 8, wherein a slot groove of a predetermined length is provided on an outer peripheral surface of the body portion, wherein an end of the control unit is inserted into the slot groove, and wherein the control unit is supported by a rotation bar passing through a center thereof and a fixing unit disposed on both ends of the rotation bar.

* * * * *